US008905671B2

(12) United States Patent
Weatherwax

(10) Patent No.: US 8,905,671 B2
(45) Date of Patent: Dec. 9, 2014

(54) HIGH SPEED RACEWAY BARRIER

(71) Applicant: John Weatherwax, Costa Mesa, CA (US)

(72) Inventor: John Weatherwax, Costa Mesa, CA (US)

( * ) Notice: Subject to any disclaimer, the term of this patent is extended or adjusted under 35 U.S.C. 154(b) by 105 days.

(21) Appl. No.: 13/791,473

(22) Filed: Mar. 8, 2013

(65) Prior Publication Data

US 2014/0252289 A1 Sep. 11, 2014

(51) Int. Cl.
*E01F 13/02* (2006.01)
*E01F 15/06* (2006.01)

(52) U.S. Cl.
CPC ..... *E01F 15/06* (2013.01); *E01F 13/02* (2013.01)
USPC ..... 404/6; 256/13.1

(58) Field of Classification Search
CPC ..... E01F 13/02; E01F 15/06
USPC ..... 404/6; 256/13.1
See application file for complete search history.

(56) References Cited

U.S. PATENT DOCUMENTS 3,307,833 A * 3/1967 Muller et al. ..... 256/13.1
3,388,892 A * 6/1968 Case ..... 256/13.1
4,685,656 A * 8/1987 Lee et al. ..... 256/13.1
4,780,020 A * 10/1988 Terio ..... 404/6
5,186,438 A * 2/1993 Cross et al. ..... 256/13.1
5,676,350 A * 10/1997 Galli et al. ..... 256/13.1
5,961,099 A * 10/1999 Thommen, Jr. ..... 256/12.5
6,733,204 B1 * 5/2004 Paniccia ..... 404/6
7,116,237 B2 * 10/2006 Kopp ..... 340/626
7,128,308 B2 * 10/2006 Marsh et al. ..... 256/13.1
7,497,640 B2 * 3/2009 Sharp et al. ..... 404/6
8,376,651 B2 * 2/2013 Kulp et al. ..... 404/6

* cited by examiner

*Primary Examiner* — Raymond W Addie
(74) *Attorney, Agent, or Firm* — Gene Scott; Patent Law & Venture Group

(57) ABSTRACT

A barrier alongside a raceway or track providing safety to spectators when a racecar tends to leave the raceway. The barrier has a rigid base wall for deflecting racecars that may contact it. Secured to the base and extending upwardly are spaced apart rigid posts. Each post is covered by a deflector. Horizontally extensive steel cables are secured to the posts and deflector; the cables being arranged in mutually parallel vertically spaced apart positions one above the next. The deflector provides stand-off legs to which a spectator safety screen is attached. Racecars may strike the base at high speed and may leave the raceway and contact the cables which will restrain them. The deflector provides angled surfaces for deflecting vehicles and flying parts back toward the raceway. Flying debris is prevented from reaching spectators by the safety screen.

7 Claims, 4 Drawing Sheets

HIGH SPEED RACEWAY BARRIER

BACKGROUND

Barriers are divided into three groups, based on the amount they deflect when struck by a vehicle and the mechanism the barrier uses to resist the impact forces. In the United States, traffic barriers are tested and classified according to the AASHTO Manual for Assessing Safety Hardware (MASH) standards. Barrier deflections are related to crash tests with a 2,000 kg (4,400 lb) pickup truck traveling 100 km/h (62 mph), colliding with the rail at a 25 degree angle. Flexible barriers include cable barriers and weak post corrugated guide rail systems. These are referred to as flexible barriers because they will deflect 1.6 to 2.6 m (5.2 to 8.5 ft) when struck by a typical passenger car or light truck. Impact energy is dissipated through tension in the rail elements, deformation of the rail elements, posts, soil and vehicle bodywork, and friction between the rail and vehicle. Semi-rigid barriers include box beam guide rail, heavy post blocked out corrugated guide rail and three-beam guide rail. Three-beam is similar to corrugated rail, but it has three ridges instead of two. They deflect 3 to 6 feet (0.91 to 1.83 m): more than rigid barriers, but less than flexible barriers. Impact energy is dissipated through deformation of the rail elements, posts, soil and vehicle bodywork, and friction between the rail and vehicle. Box beam systems also spread the impact force over a number of posts due to the stiffness of the steel tube. Rigid barriers are usually constructed of reinforced concrete. A permanent concrete barrier will deflect a negligible amount when struck by a vehicle. Instead, the shape of a concrete barrier is designed to redirect a vehicle into a path parallel to the barrier. This means they can be used to protect traffic from hazards very close behind the barrier, and generally require little maintenance. Impact energy is dissipated through redirection and deformation of the vehicle itself. Jersey barriers and F-shape barriers also lift the vehicle as the tires ride up on a angled lower section. The disadvantage of rigid barriers is that there is a high likelihood of rollover. Impact forces are resisted by a combination of the rigidity and mass of the barrier.

For high-speed vehicular traffic, as for instance on a race track special barriers are used to deflect and absorb energy delivered to them. One race track barrier system is defined by U.S. Pat. No. 6,059,487 provides enhanced strength and elasticity for absorbing greater energy during impacts without causing permanent damage to either the vehicle or the barrier, and also provides enhanced properties for redirecting a vehicle during impact. Furthermore, it can be easily assembled in the field from a few, basic, light-weight components. It can also be configured in almost any shape, and is easily reconfigured or, in the case of impact, restored to its original position. Thus, it is well suited to racing tracks, where it is able to be relatively easily laid out, restored and reconfigured. A barrier system according to the present invention is formed from a plurality of barrier modules pivotally linked together to form a barrier chain. Each barrier module can be assembled from a few basic components. These components include an elastically or resiliently deformable barrel rotatably mounted between a pair of links. The barrel is journailed on a pin that extends between the pair of links. This same pin can be used to pivotally connect two modules by overlapping end portions of the links from the respective modules. Each module further includes a spacer between the pair of links. The spacer maintains separation between the links so that the barrel is free to rotate. Furthermore, the spacer is structurally joined with the top and bottom links to create a rigid structure when the module is assembled. The resulting structure thus tends to resist twisting. The chain of barrier modules may be anchored by one or more of the pins extending into bore holes in the ground or a footing.

A further race track barrier system is defined by U.S. Pat. No. 6,702,513 wherein a smooth wall is hinged or pivoted at its bottom edge and is able to move to an upright position against a crushable material positioned behind the wall thereby absorbing the energy of a crashing vehicle. The wall extends outwardly toward the track so that vehicles tend to be prevented from leaving the road surface. The barrier defined herein is primarily designed to protect spectators when high speed racecars crash at very high speed and often have enough kinetic energy to leave the racing surface.

BRIEF SUMMARY AND ADVANTAGES

The present disclosure describes a barrier apparatus (barrier) specifically designed for safeguarding spectators at raceways, but as described and with modifications, it has additional potential use in private enterprise, public use, and in government related applications, as for instance in crowd control and illegal immigration movements across borders.

The barrier has a rigid base wall for deflecting vehicles that may contact it. Secured to the base and extending upwardly are spaced apart rigid posts or stanchions. Each post is covered by a deflector which tends to push a vehicle or flying debris to one side of the post (an implacable object) when contact is made. Horizontally extensive steel cables are secured to the posts and deflector; the cables being arranged in mutually parallel vertically spaced-apart positions one above the next. The deflectors provide stand-off legs to which an upright spectator safety screen is mounted. Vehicles may strike the base at high speed and may leave the road surface thereby contacting the cables which prevent the vehicle from passing over or through the barrier to endanger spectators while still allowing adequate spectator visibility of the race cars for instance. Flying debris is prevented from reaching spectators by the use of the upright safety screen which is positioned well back from the cables and posts.

An advantage of using the deflectors of the type described herein is that they deflect and lessen the impact of a vehicle that might contact a pole at high speed.

Another advantage of using deflectors of the type described herein is that they provide for attachment of a spectator screen which provides protection against flying crash debris.

Another advantage of using deflectors of the type described herein is that they prevent a vehicle from becoming entangled in wire fencing which has the undesirable effect of tearing a vehicle to pieces sending shrapnel flying toward spectators and also prevents the very high forces that are delivered to drivers due to extreme deceleration of their vehicle.

Another advantage of the presently described barrier construction is that it is a low cost solution that is easily adapted to existing raceways and speedways.

The details of one or more embodiments of these concepts are set forth in the accompanying drawings and the following description. Other features, objects, and advantages of these concepts will be apparent from the description and drawings, and from the claims.

BRIEF DESCRIPTION OF THE SEVERAL VIEWS OF THE DRAWING

Like reference symbols in the various drawings indicate like elements.

DETAILED DESCRIPTION

Figure 1:
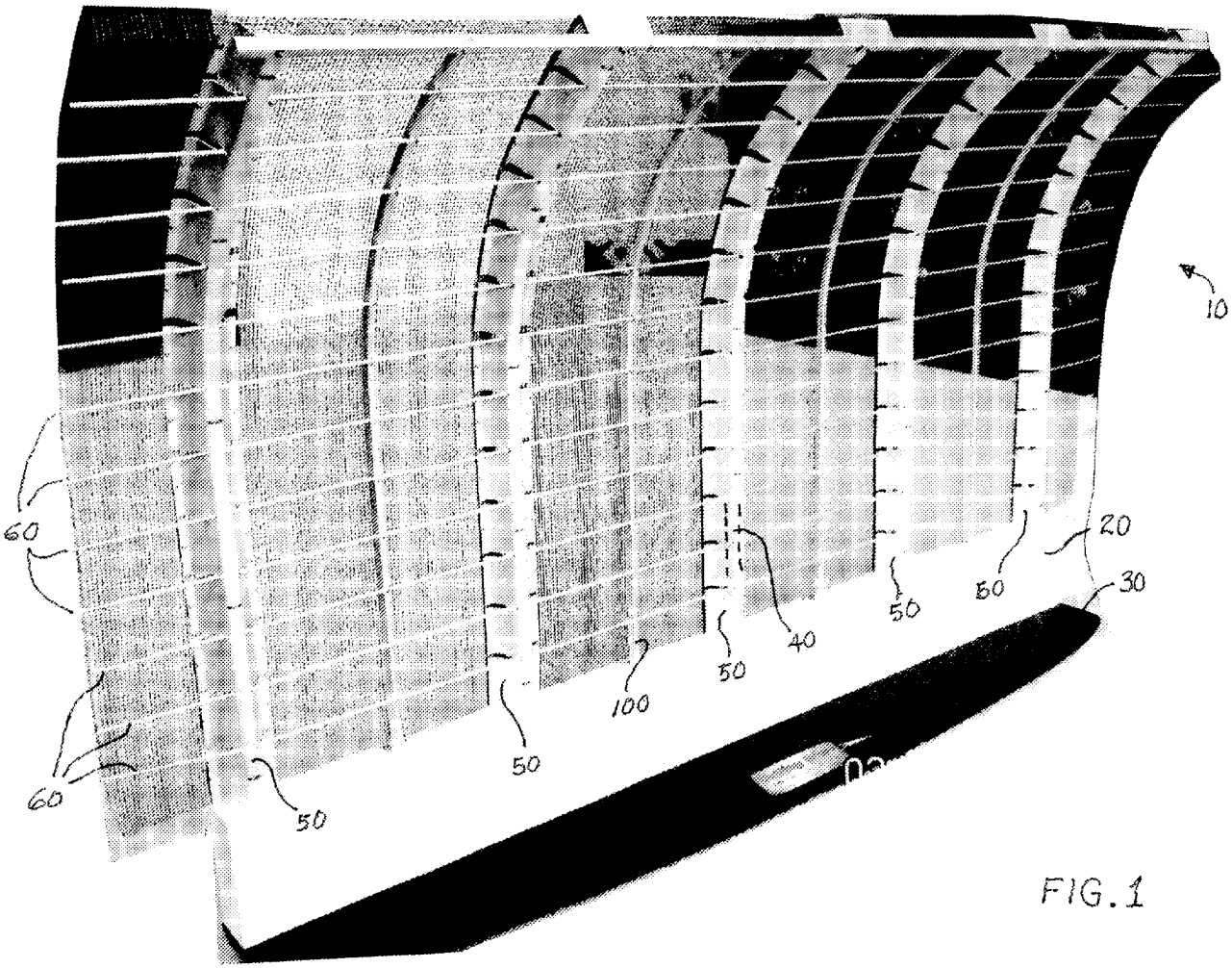
FIG. 1 is an example perspective view of a length of the presently described barrier apparatus as seen from the roadway side of the apparatus.
Figure 3:
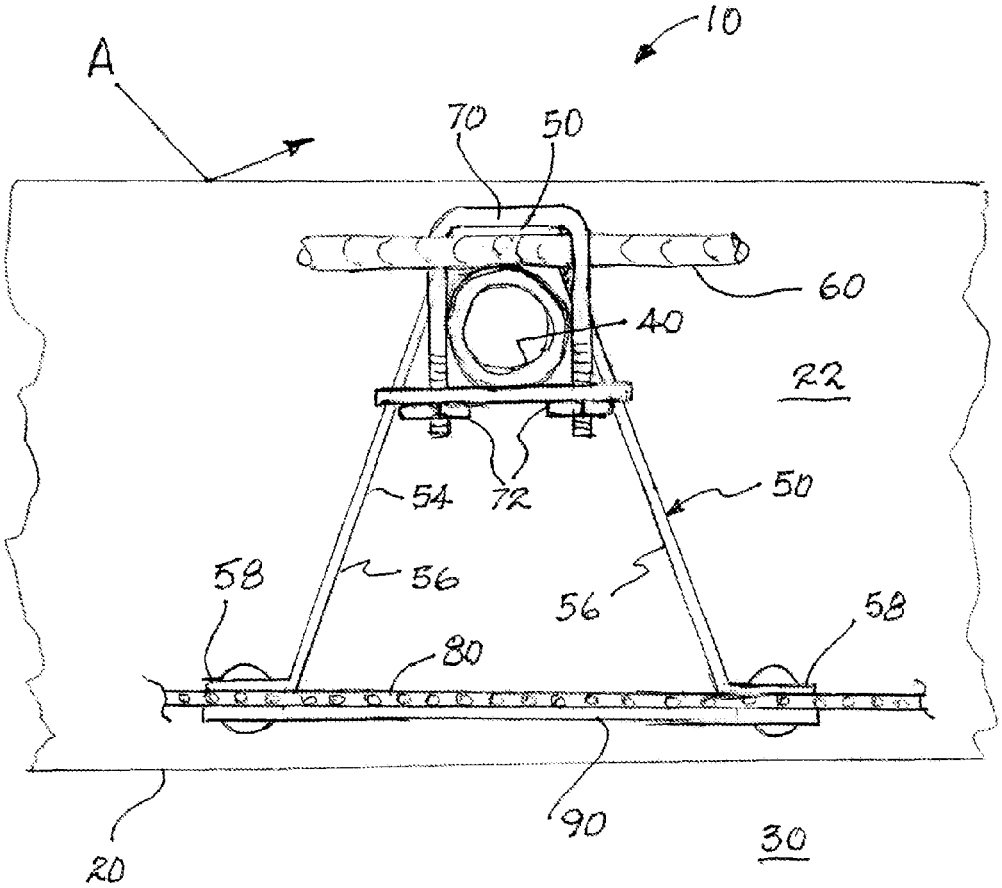
FIG. 3 is an example top plan sectional view taken along line 3-3 in FIG. 2.

FIG. 1 illustrates a barrier 10 for separating vehicular traffic from spectators in a racing venue. The barrier 10 may have a rigid, stationary, elongated base 20 that may be secured to a permanent surface 30 such as a ground or shoulder of a raceway. Base 20 may be a concrete wall which functions to deflect racing vehicles that may stray from the racetrack, as illustrated in FIG. 3 by arrow "A". Base 20 may support rigid, upright posts 40 spaced apart along base 20, wherein each post 40 may be secured at it lower end to base 20 so that posts 40 may be held in a rigid upright attitude. Each post 40 has a deflector 50 placed over it as is clearly shown in FIG. 1. Posts 40 are not visible in FIG. 1 as they are secured within the interior of deflectors 50. The deflectors 50 are roughly V-shaped having two legs, and are segmented by slots 52 open cut-away portions, on both legs at intervals. The posts 40 may be bent over starting midway above the base 20 and the segmentation of the deflectors 50 enables them to follow the curved aspect of the poles 40 as can be seen in FIG. 1.

Figure 2:
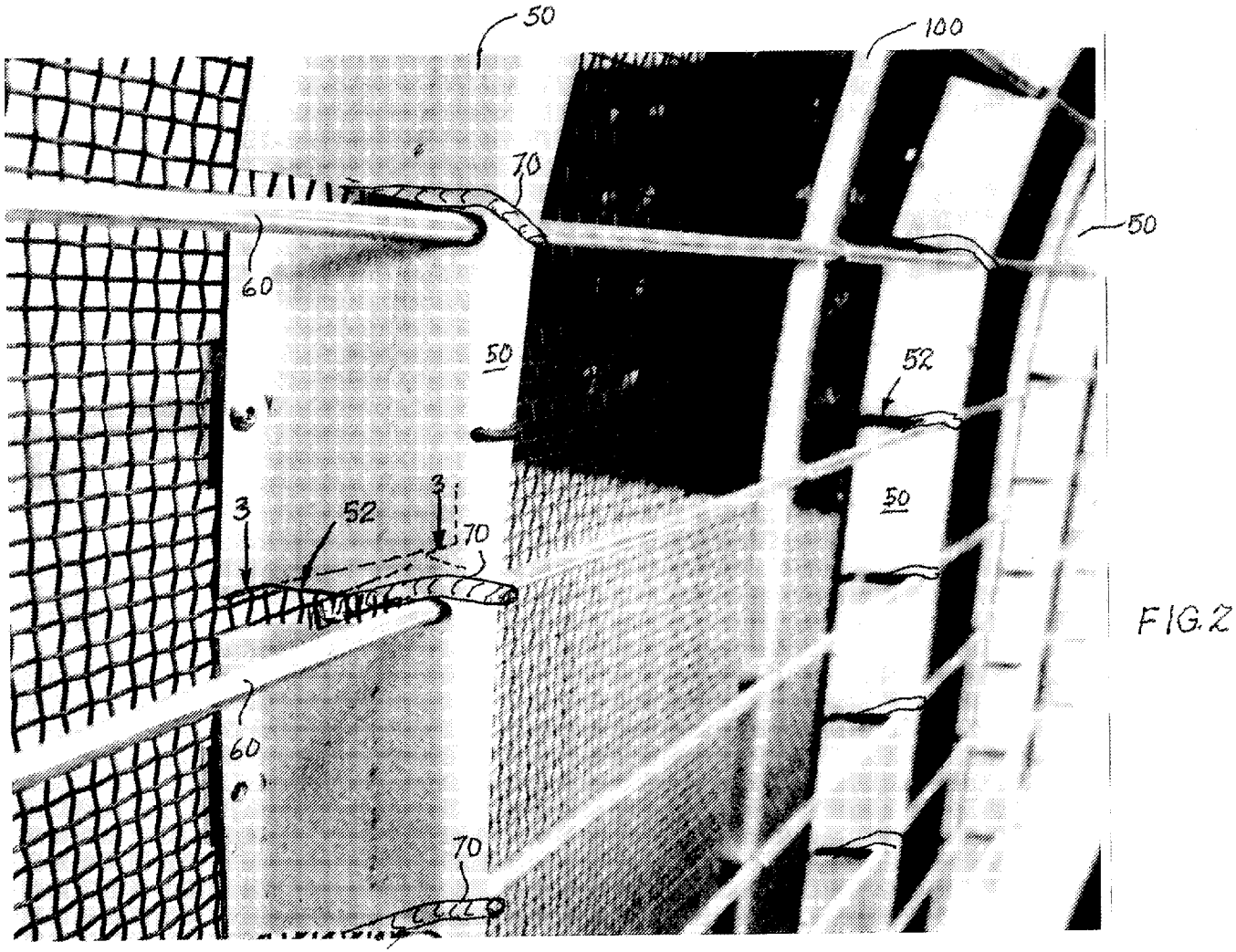
FIG. 2 is a close-up portion of FIG. 1 showing deflectors of the apparatus in greater detail and indicating a cutting plane 3-3.

Flexible cables 60, as best seen in FIG. 2, and shown as stiff rods in FIGS. 1 and 2, are positioned roughly in perpendicular to posts 40, that is, extending horizontally in-line with base 20. Cables 60 lie in the slots 52 of deflectors 50 and are in contact with an interior surface 54 of each of deflectors 50. Cables 60 also contact posts 40 as best seen in FIG. 3 where a relationship between cables 60, poles 40 and deflectors 50 is shown.

FIG. 3 also shows that a tie 70 such as a U-bolt may be used to fasten cable 60 to each deflector 50. Of course other means may be applied for instance, cables 60 may be welded to posts 40 and then deflectors 50 may be welded to both cables 60 and posts 40. In FIG. 3 it is shown that tie 70 may be fastened in place after its legs pass through slots 52 in deflector 50. To reiterate, cables 60 pass into and through the interior of deflector 50. When fasteners 72 are tightened, posts 40, cable 60, and interior surface 54 are compressed together and secured in place.

Referring still to FIG. 3, side legs 56 of deflector 54 extend away from cable 60 and post 40 and provide flanges 58 to which safety screen 80 is fastened by common hardware. As shown in FIG. 1 screen 80 may extend from the top of barrier 10 to the top surface 22 of base 20 and may be made of a highly resilient yet tough steel wire woven and welded in any appropriate pattern that permits visibility of a race by spectators through screen 80 and yet prevents flying objects to pass. Legs 56 are long enough to place screen 80 from being contacted by vehicles and most flying debris projected toward the spectators in severe high speed crashes into barrier 10. This spacing is predicated by the expected kinetic energy that might be released in such crashes and therefore depends on the nature of the racetrack or speedway.

Figure 4:
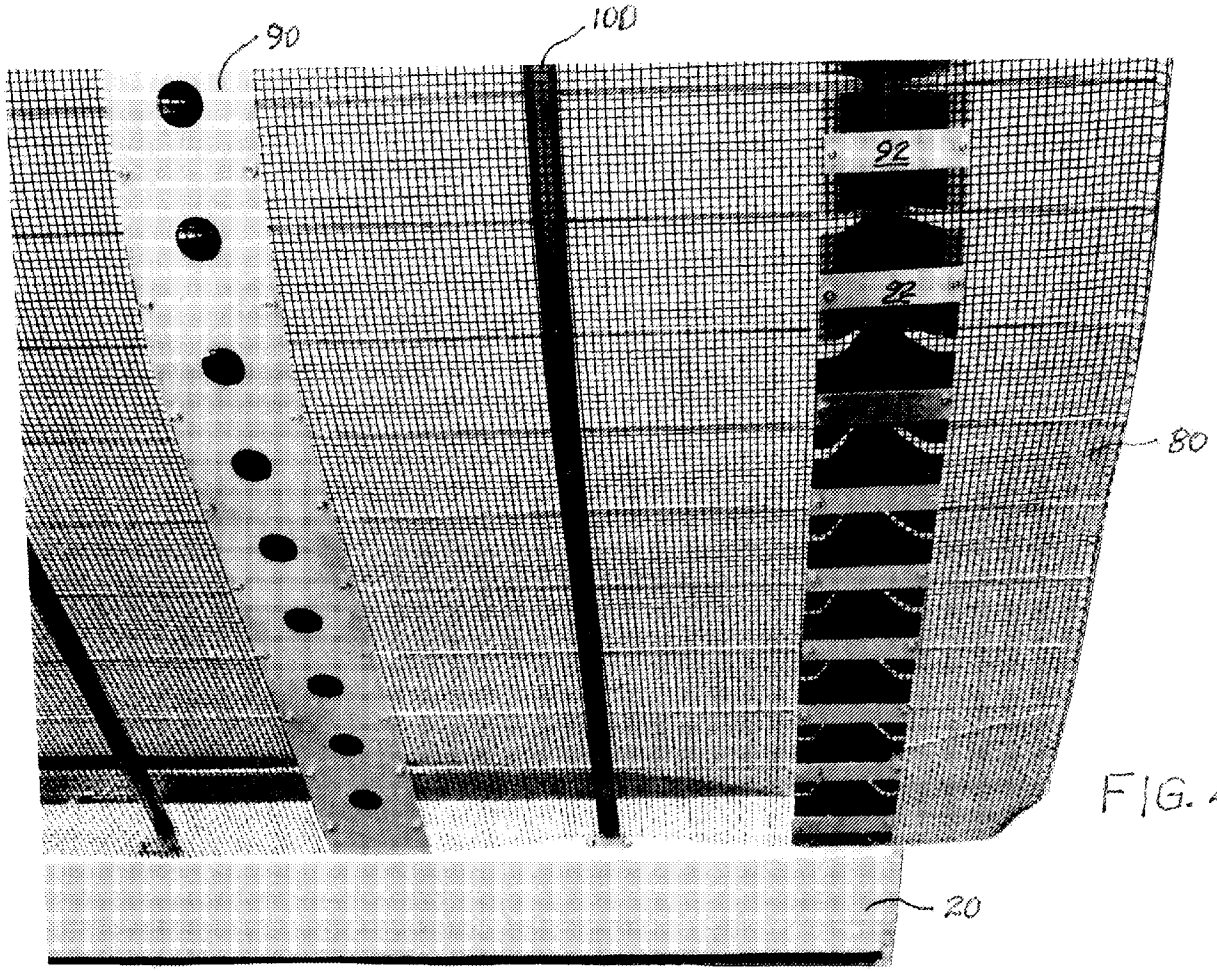
FIG. 4 is a perspective view of a portion of the barrier apparatus of FIG. 1 as seen from the spectator side of the barrier apparatus, and showing backing strips of the barrier apparatus.

Safety screen 80 may be sandwiched between flanges 58 and a strip 90 such as a flexible steel strip as shown in FIG. 4. Alternately, this fastening made by strip 90 may be replaced with short strips 92, also shown in FIG. 4. Common hardware such as rivets, screws, etc. may be used to join deflector flanges 58, screen 80 and strips 90 or 92.

As shown in FIGS. 1, 2, and 4, extruded rods 100, U-shaped channels or similar structural shapes, may be centered between posts 40. Rods 100 are interconnected with cables 60 using common hardware such as U-bolts, so as to help prevent cables 60 from spreading apart upon receiving vehicular impact. Such rods 100 may be secured to the base surface 22 as shown in FIG. 4, and extend upwardly in parallel with posts 40.

Embodiments of the subject apparatus and method have been described herein. Nevertheless, it will be understood that various modifications may be made without departing from the spirit and understanding of this disclosure. Accordingly, other embodiments and approaches are within the scope of the following claims.

What is claimed is:

1. A raceway barrier comprising:

an elongated, rigid, and stationary, base secured to a fixed surface, the base having a forward and a rearward positions transversally separated thereon;

a rigid upright post secured at one end within the base in the forward position;

an upright deflector covering the post at the forward position and extending rearward on the base to the rearward position, the deflector having a V-shape with divergently angular oriented surfaces;

a flexible cable positioned perpendicular to the post and in-line with the base, the cable in contact with an interior surface of the deflector at the forward position, and in contact with the post;

an elongated fence fabric positioned in-line with the base and in parallel with the cable, the fence fabric secured to the deflector at the rearward position.

2. The barrier of claim 1 wherein portions of the fence fabric are secured between the deflector and a backing plate.

3. The barrier of claim 1 wherein the fence fabric has a lower edge adjacent to the base and an upper edge adjacent to a free end of the post.

4. The barrier of claim 1 further comprising a rigid tie surrounding portions of the deflector, the cable, and the post compressively.

5. The barrier of claim 1 wherein the cable and the fence fabric are positioned apart.

6. The barrier of claim 1 wherein the fence fabric has openings enabling visibility through the fence fabric and preventing racecar crash debris from passing through.

7. The barrier of claim 1 further comprising an upwardly extending rod engaged at a lower end thereof with the base and extending upwardly in a position spaced apart from the post, the rod joined with the cable.

* * * * *